US005368213A

United States Patent [19]

Massari, Jr.

[11] Patent Number: 5,368,213

[45] Date of Patent: Nov. 29, 1994

[54] MAGAZINE FOR A PNEUMATIC FASTENER DRIVING TOOL

[75] Inventor: Donald J. Massari, Jr., Cincinnati, Ohio

[73] Assignee: Senco Products, Inc., Cincinnati, Ohio

[21] Appl. No.: 55,142

[22] Filed: Apr. 29, 1993

[51] Int. Cl.[5] ..... B25C 1/00

[52] U.S. Cl. ..... 227/123; 227/120; 227/127

[58] Field of Search ..... 227/109, 120, 127, 128, 227/123

[56] References Cited

U.S. PATENT DOCUMENTS

| | | | |
|---|---|---|---|
| 3,437,250 | 4/1969 | Fiedler | 227/127 |
| 3,633,811 | 1/1972 | Ploen | 227/120 |
| 4,304,349 | 12/1981 | Novak et al. | 227/109 |
| 4,524,896 | 6/1985 | Morrell, Jr. | 227/128 |
| 4,570,840 | 2/1986 | Bull | 227/120 |
| 4,815,647 | 3/1989 | Chou | 227/120 |

*Primary Examiner*—Scott Smith

*Attorney, Agent, or Firm*—Jerrold J. Litzinger

[57] ABSTRACT

An improved magazine for a fastener driving tool having a two piece back plate allowing easy access to the drive track for removing jammed fasteners from the tool. The magazine consists of a first fixed rail having a back plate section perpendicular to the rail, and a second rail slidable with respect to the fixed rail, having a second back plate section perpendicular to the rail. When the magazine is in the fastener driving position, the back plate sections provide extra support for the drive track.

7 Claims, 4 Drawing Sheets

MAGAZINE FOR A PNEUMATIC FASTENER DRIVING TOOL

BACKGROUND OF THE INVENTION

1. Field of the Invention

The present invention relates generally to an improved magazine for a pneumatic fastener driving tool, and in particular, to an improved magazine which allows the user to easily clear a tool which has a fastener jammed in the drive track.

2. Description of the Prior Art Prior art workers have devised many types of pneumatically operated tools for driving fasteners. Patents such as U.S. Pat. No 2,983,922 which issued to Juilfs and corresponding Re. U.S. Pat. No. 26,262 describe pneumatic fastener driving tools which are characterized as having a guide body extending laterally from the pneumatic member at a forward end and including a driver extending from the pneumatic member through a drive channel in the guide body. A magazine is fixed to the underside of the pneumatic member with an open feed end extending into the guide body and having a tensioning mechanism for feeding fasteners into the drive channel.

From time to time, a fastener may become jammed within the drive track of the tool, making it necessary to remove the jammed fastener before the tool can function properly. This problem has been addressed several times in the prior art.

U.S. Pat. No. 2,733,440, which issued to Jenny, describes a fastener driving tool in which the magazine is pivotally affixed to the tool at the center of the upper side of the magazine, so it may be pivoted away from the nosepiece, making it easy to remove jammed fasteners from the drive track. U.S. Pat. No. 3,437,250, which issued to Fiedler, teaches a tool having a slidable side wall member movable to expose the interior of the magazine and drive track, although the drive track still remains partially obstructed.

U.S. Pat. No. 4,304,349, which issued to Novak et al., describes a tool having a first and second nose members which define the drive track, and first and second slidable track members which define the fastener track within the magazine. The first nose member is fixed to the tool body, while the second nose member is supported in the second track member. In order to clear a jam, both the first and second track members are retracted to separate the first and second nose members, allowing access to the drive track.

Although the prior art references all teach different methods of clearing jams from the drive track of fastener driving tools, each of these has deficiencies in terms of complexity, convenience, or ease of operation.

For example, although the device taught in U.S. Pat. No. 4,304,349 makes it easier to clear jammed fasteners from the drive track than the earlier references, the process is a two step operation in which the first track member is initially retracted, followed by the retraction of the second track member. In addition, the second track member can only be retracted a short distance, as can be seen in FIG. 13 of the patent, thus limiting the access to the drive track. Finally, as the first end of the track member is generally J shaped, it provides little support for the front plate of the tool during a drive cycle, when very large forces are applied, especially when a fastener jams against the front plate during operation of the tool.

SUMMARY OF THE INVENTION

It is therefore an object of the present invention to provide an improved magazine for a fastener driving tool which allows excellent access to the drive track when removing jammed fasteners.

It is also an object of the present invention to provide strong support for the drive track members during the driving of a fastener.

It is a further object of the present invention to provide a magazine which is less complex, lighter, and has fewer parts than those previously available.

These and other objects of the present invention are accomplished by a novel magazine for use in a fastener driving tool having a first rail rigidly affixed to the body of the tool, and which contains a first fixed backplate section perpendicular to the second rail which is affixed to the front plate, and a second rail, slidably supported on the first rail, which contains a second backplate section perpendicular to the rail. The second rail may be moved to the end of the first rail distant from the front plate, making it very easy to remove any fastener which is jammed within the drive track of the tool.

DETAILED DESCRIPTION OF THE PREFERRED EMBODIMENT

Figure 1:
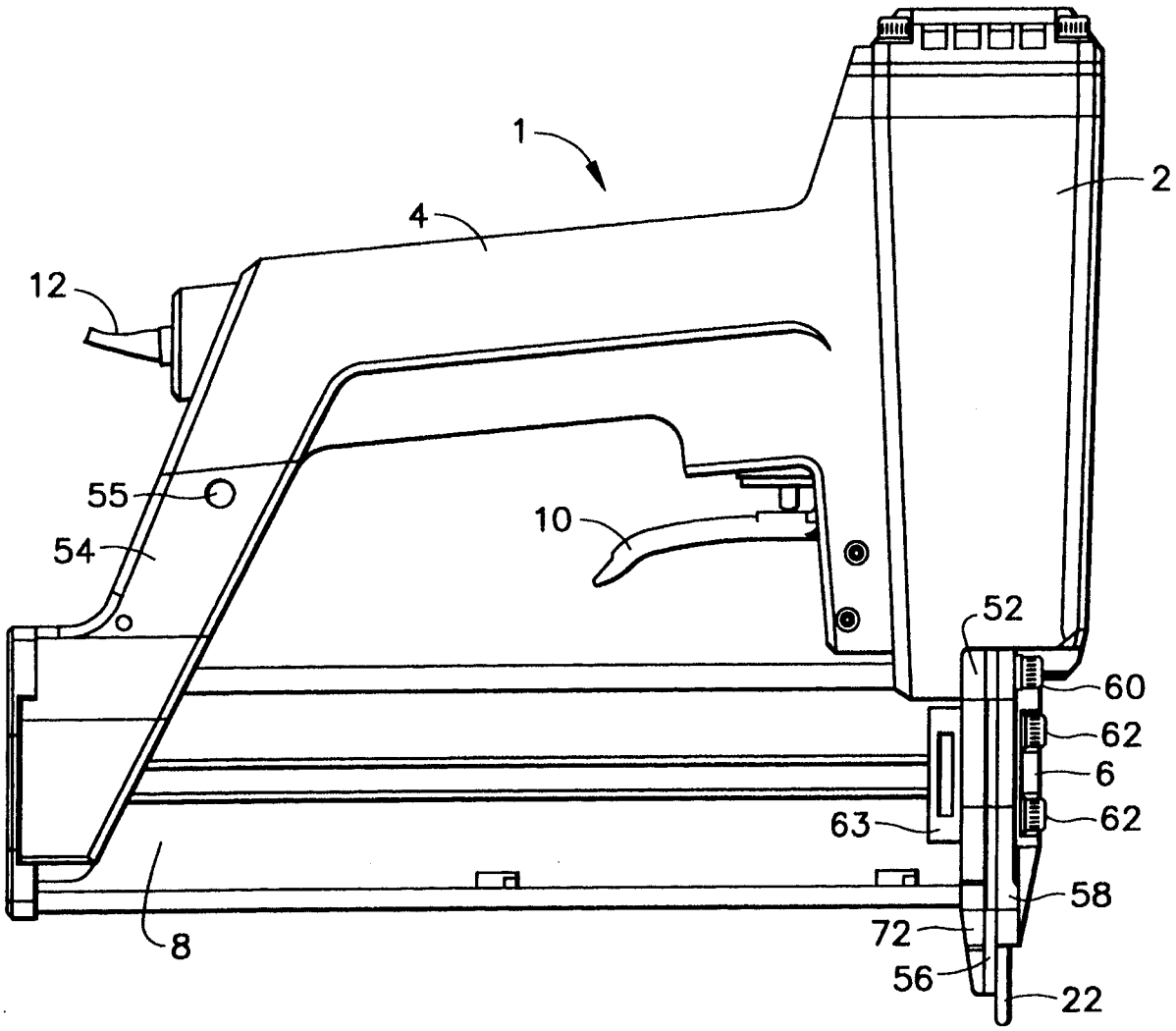
FIG. 1 is a side elevational view of an exemplary fastener driving tool containing the present invention.
Figure 6:
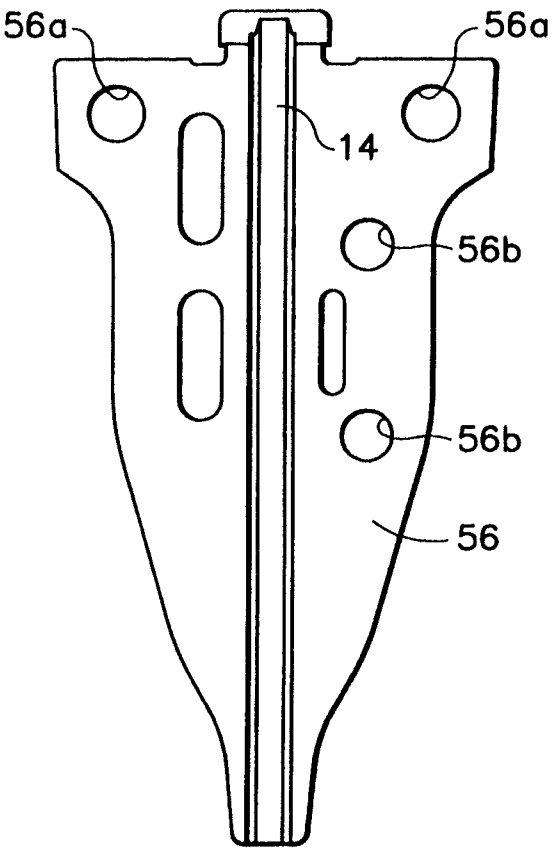
FIG. 6 is an elevational view of the rear of the front plate of the present invention.
Figure 2:
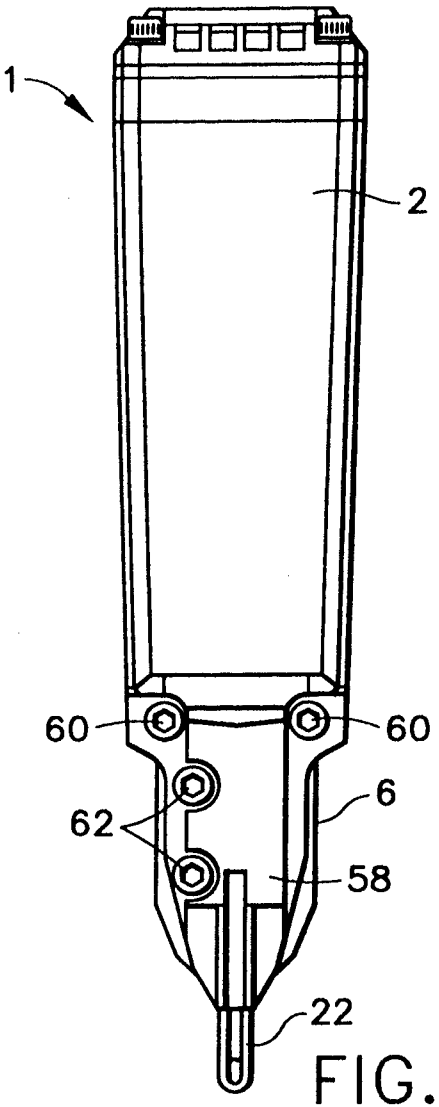
FIG. 2 is a front elevational view of the tool shown in FIG. 1.
Figure 3:
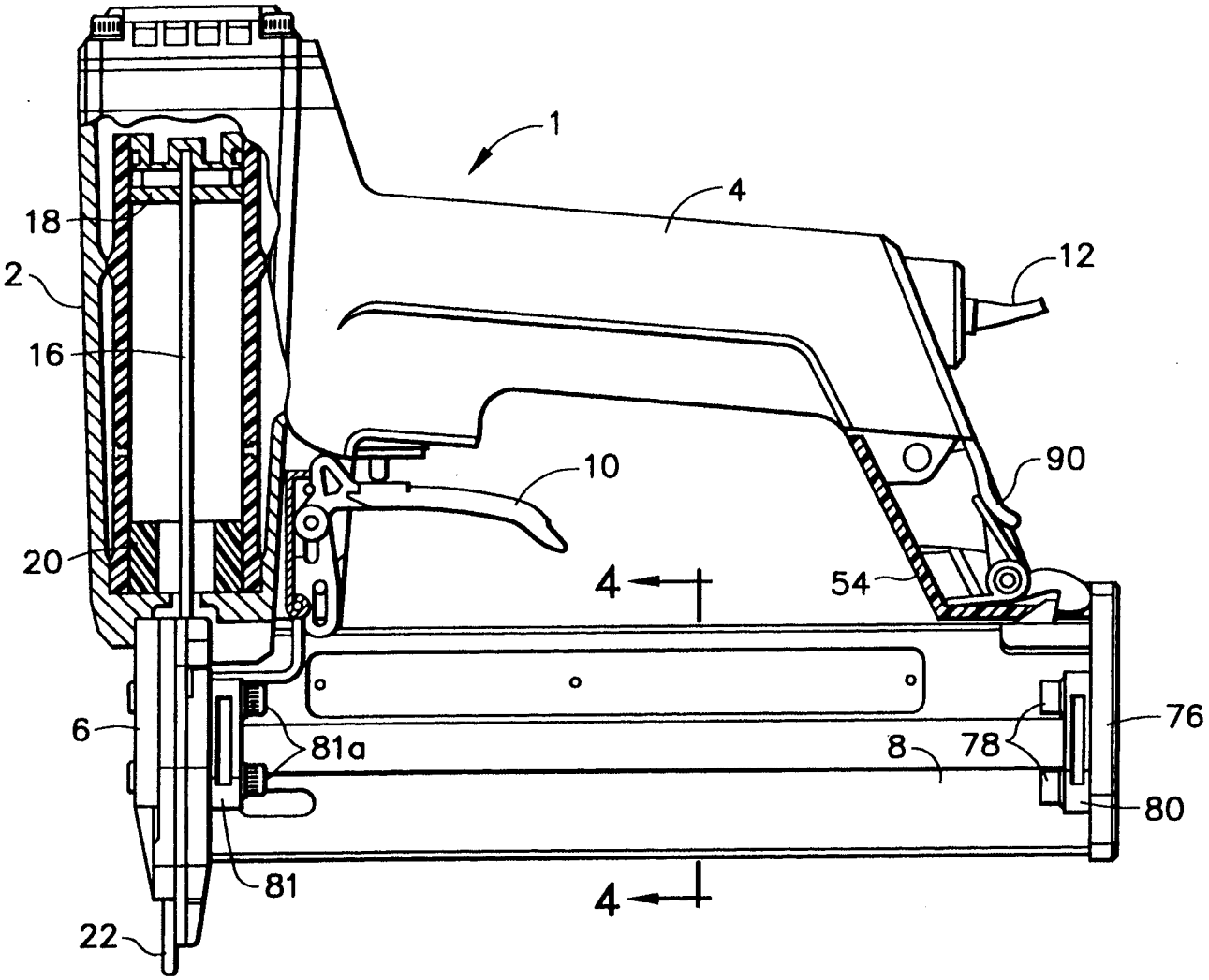
FIG. 3 is a fragmentary elevational view of the other side of the tool shown in FIG. 1.

An exemplary embodiment of a fastener driving tool containing the present invention is illustrated in FIGS. 1–3. The tool is generally indicated at 1, and comprises a body portion 2, a handle portion 4, a nose portion 6, and a magazine portion 8. The underside of handle portion 4 contains a trigger 10, while a fitting 12 is located at the end of handle portion 4 for use in attaching tool 1 to an air source for operating tool 1. Nose portion 6, which is located at the front end of magazine 8 at the lower end of main body portion 2, contains a drive track 14 (FIG. 6) for a driver blade 16. Driver blade 16 is attached to a piston 18 such that when the tool is operated, air forces piston 18 downward, causing driver blade 16 to force a fastener located in drive track 14 out from the end of nose portion 6 and into the workpiece. At the end of this drive cycle, piston 18 strikes a piston stop 20, stopping the downward movement of driver blade 16. U.S. Pat. No. 4,688,710, which is assigned to the present assignee, provides a detailed description of the pneumatic operation of the tool shown in the preferred embodiment.

A tool of the type described is normally provided with a safety interlock. The most common type of safety comprises a workpiece contacting safety 22 which, when nose portion 6 is placed against a workpiece, contacts the workpiece and is urged upwardly thereby, as viewed in FIG. 1. Safety 22, which is normally urged downward by a spring 23 (FIG. 5), normally disables trigger 10 unless it is in its actuated position with nose portion 6 in contact with the workpiece; thus, tool 1 will not operate unless trigger 10 and safety 22 are actuated at the same time.

Figure 5:
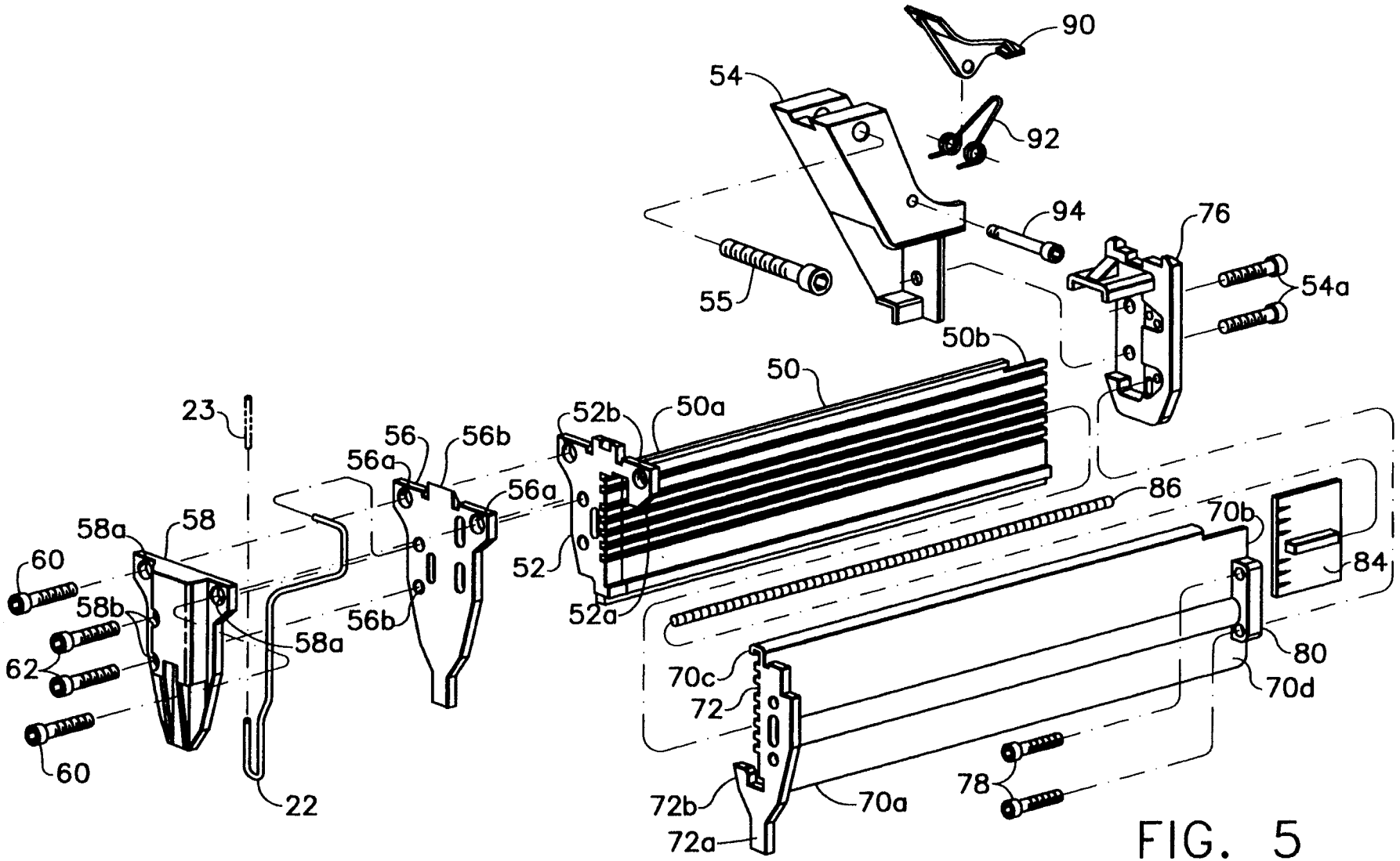
FIG. 5 is an exploded view of the magazine of the tool shown in FIG. 1.

Referring now to FIG. 5, the magazine of the present invention can be most clearly seen. A stationary rail 50 has a forward end 50*a* and a rearward end 50*b*. At forward end 50*a*, rail 50 terminates in a guide body section 52. Guide body section 52 is perpendicular to rail 50, and contains a section 52*a* which extends to the opposite side of rail 50. The rearward end 50*b* of rail 50 is fastened to a magazine support assembly 54 by a pair of screws 54*a* which is, in turn, affixed to the underside of handle portion 4 by a screw 55, as can be seen in FIG. 1. The forward end 50*a* of rail 50 is fastened at nose portion 6, as guide body section 52 abuts a front plate 56, and a cover plate 58 is fastened to guide body 52 and plate 56 by a pair of screws 60 which attach this assembly to the underside of body portion 2 by passing through holes 58*a*, 56*a*, and 52*b* in the respective parts, as can be seen in FIG. 1. Rail 50 is additionally supported at nose portion 6 by virtue of a pair of screws 62 which pass through cover plate 58 and front plate 56 via holes 58*b* and 56*b* and engage a support 63 located behind of guide body section 52.

A moveable rail 70 has a forward end 70*a*, rearward end 70*b*, and an upper curved portion 70*c* and lower curved portion 70*d* along the length of rail 70. At forward end 70*a*, rail 70 terminates in a guide body section 72. Guide body section 72 is perpendicular to rail 70, and contains an extension 72*a* which extends below rail 70. End 70*b* of rail 70 is attached to a latch plate 76 by virtue of a pair of screws 78 which pass through a support 80 and engage plate 76. Forward end 70*a* contains a support 81 which abuts guide body section 72 and is fastened to section 72 with a pair of screws 81*a* to add additional strength to this assembly.

Figure 4:
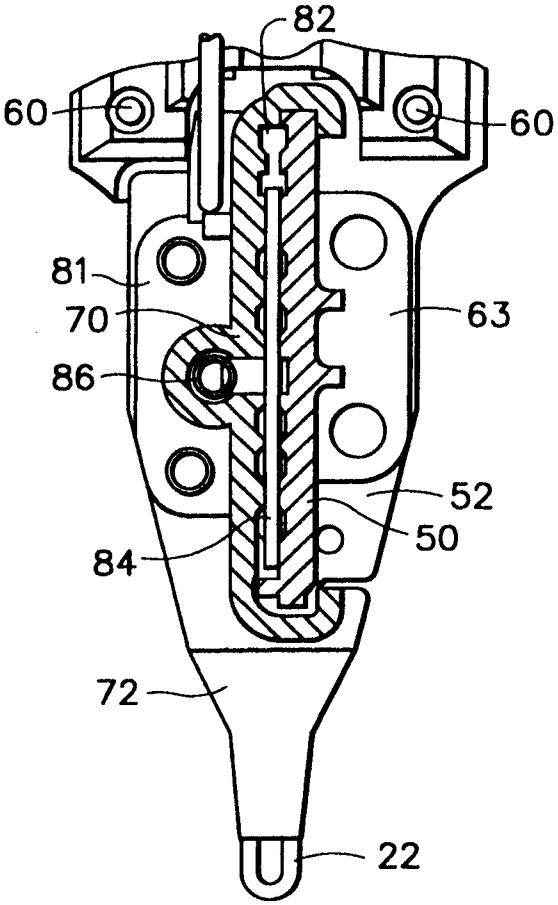
FIG. 4 is a cross-sectional view taken along section line 4—4 of FIG. 3.

When magazine 8 is assembled, moveable rail 70 is slid onto stationary rail 50, with upper curved portion 70*c* moving along the top edge of rail 50, and lower curved portion 70*d* moving along the bottom edge of rail 50. Extension 72*b* of guide body section 72 also curves around the bottom edge of rail 50. A fastener track 82 is formed between the rails 50 and 70, as can be clearly seen in FIG. 4. Fasteners in track 82 are urged forwardly by a feeder shoe 84 which is attached to a spring 86 nestled within rail 70 against latch plate 76. The travel of movable rail 70 in the rearward direction is restricted by virtue of guide body 72 contacting support assembly 54. When rail 70 is in its forwardmost portion, it is held in place by a latch 90, which is biased by a spring 92 held by a screw 94 such that it cooperates with latch plate 76 to keep magazine 6 in the closed position.

To operate tool 1, magazine 6 is loaded with fasteners by retracting rail 70 to its rearwardmost position and inserting a strip of fasteners against the inside of rail 50. Rail 70 is then moved to its forwardmost position in which guide body section 72 contacts front plate 56. Rail 70 is held firmly in this position by latch 90 cooperating with latch plate 76. Fasteners in feed track 82 are urged forwardly into drive track 10 by feeder shoe 84 under the influence of spring 86.

During the drive sequence, great forces are generated by driver blade 16 contacting a fastener in drive track 14. Much of this force is transmitted to the parts surrounding drive track 14, such as front plate 56 and rails 50 and 70. The design of rails 50 and 70, with guide body sections 52 and 72 respectively, which are located perpendicular to the rails, act to strengthen this section of the magazine, adding to the durability and reliability of the tool.

In addition, when a fastener becomes jammed within drive track 14, it can easily be removed by disengaging latch 90 from latch plate 76 and sliding rail 70 to its rearwardmost position, thus leaving drive track 14 readily accessible. This is accomplished by moving only one rail, which rail can be shifted to a position away from the front plate where the operator can remove the jammed fastener without any obstruction.

While the invention has been shown and described in terms of a preferred embodiment thereof, it will be understood that this invention is not limited to this particular embodiment and that many changes and modifications may be made without departing from the true spirit and scope of the invention as defined in the appended claims.

What is claimed is:

1. An improved magazine for use with a fastener driving tool, said tool having a body, a driver assembly movable within the body through a drive stroke, a front plate rigidly affixed to said body having a recess defining a drive track for the drive stroke of said driver assembly, said magazine comprising:

a first magazine rail, rigidly affixed to said body, having a first fixed back plate section extending outwardly and perpendicular to said first magazine rail and rigidly affixed to said front plate adjacent to said drive track;

and a second magazine rail, slidably supported on said first magazine rail, having a second back plate section extending outwardly and perpendicular to said second magazine rail, movable between a first position wherein said second back plate section contacts said front plate adjacent to said drive track and a second position wherein said second back plate section is distant from said front plate, said second magazine rail having an upper curved portion and a lower curved portion within which said first magazine rail is contained.

2. The magazine of claim 1, further including a support for affixing said first magazine rail to said body.

3. The magazine of claim 2, wherein said second magazine rail has a latch plate at its end opposite said second back plate section.

4. The magazine of claim 3, further including locking means coupled to said support, which cooperates with said latch plate to lock said second magazine rail in said first portion.

5. The magazine of claim 1, further including means for urging fasteners into said drive track.

6. The magazine of claim 1, further including first supporting means affixed to said first fixed back plate section, and second supporting means affixed to said second back plate section for adding further strength to said back plate sections.

7. The magazine of claim 1, whereby said second back plate section of said second magazine rail contains a downwardly depending section which contacts said front plate.

* * * * *